United States Patent [19]

May et al.

[11] Patent Number: 4,485,555

[45] Date of Patent: Dec. 4, 1984

[54] DRAFTING DEVICE FOR USE WITH COMPUTERS

[75] Inventors: Richard L. May, Manhattan Beach; Kenneth J. Curren, Thousand Oaks, both of Calif.

[73] Assignee: Androbot Singapore Pte. Ltd., Singapore

[21] Appl. No.: 500,279

[22] Filed: Jun. 2, 1983

[51] Int. Cl.[3] ..... B43L 13/00

[52] U.S. Cl. ..... 33/18 R; 446/454; 446/143

[58] Field of Search ..... 33/1 M, 18 R, 18 B, 33/26, 27 R, 32 C, 35; 46/210; 346/139 R, 139 C

[56] References Cited

U.S. PATENT DOCUMENTS

| | | | |
|---|---|---|---|
| 3,638,319 | 2/1972 | Barlow et al. | 33/18 R |
| 3,648,373 | 3/1972 | Morrison et al. | 33/18 R |
| 3,726,019 | 4/1973 | Adler | 33/18 R |
| 4,277,893 | 7/1981 | Munther | 33/1 M |

FOREIGN PATENT DOCUMENTS

| | | | |
|---|---|---|---|
| 1247474 | 10/1960 | France | 446/454 |
| 1157623 | 7/1969 | United Kingdom | 33/18 R |

*Primary Examiner*—Richard R. Stearns
*Attorney, Agent, or Firm*—Reagin & King

[57] ABSTRACT

A drawing device having a platform from which a marking instrument is suspended and wheels for moving the instrument over the surface of a drawing medium, a pair of these wheels being mounted equidistantly on opposite sides of the instrument, each of the pair of wheels being mounted to rotate freely, another of these wheels being a drive wheel depending from the platform and separated from the instrument on a line therefrom perpendicular to a line connecting the pair of wheels and the instrument. The device has an arrangement for moving the drive wheel to cause the drawing device to move and for varying the angle at which the drive wheel moves.

8 Claims, 10 Drawing Figures

DRAFTING DEVICE FOR USE WITH COMPUTERS

BACKGROUND OF THE INVENTION

This invention relates to drawing instruments and, more particularly, to drawing instruments used in conjunction with computers for teaching the basic elements of computer programming.

Drafting instruments have long been used with computers to turn out precise representations of the material produced by the computer. As the use of computers has burgeoned and spread to the home, means of teaching the use and programming of such computers has become imperative. One of the outgrowths of this has been the generation of more and more higher level languages which are more easily conceptualized by the beginning operator.

An especially useful one of these languages, referred to by the trademark LOGO, has been devised by the Massachusetts Institute of Technology. An especially desirable feature of this language is that it allows a person learning the language to realize results with each step of learning rather than having to wait until an entire program has been produced. One of the features of the LOGO language is that the cursor (called a Turtle in LOGO) which appears on the screen, moves with each simple command, leaving, if desired, a track behind indicating where it has been. This track may be used as the output by the operator. As will be recognized, this ability makes it quite simple for a beginner to visualize and to program graphics. For this reason, LOGO has become one of the most used languages for the teaching of computer basics.

In conjunction with the LOGO language, a piece of peripheral drawing equipment has been produced which physically emulates the cursor and produces a printed output of the track followed by the turtle cursor on the cathode ray tube. This product, which is marketed as the Terrapin Turtle by Terrapin Inc. of Cambridge, Mass., is connected to a personal computer by an umbilical cord of wires through which it receives messages generated by the computer. These messages cause the device to follow a path over an output medium such as paper and produce a copy of the path (although it may be to a substantially different scale) followed by the cursor on the screen. The device has been especially useful in teaching children to program using the LOGO language because it reacts like a toy robot to the child's commands and provides a permanent output thereby turning into a game what might otherwise be a tedious learning situation.

The peripheral turtle is mechanized by a platform mounted on wheels which move it over the drafting medium in response to the commands of the computer. The platform carries a pen which may be lowered upon command to touch the surface of the paper and leave a track as the device moves.

The wheels which move the device are a pair which are positioned equidistant from and on opposite sides of the pen so that a line drawn through the lowered pen point passes through the point at which each of the wheels touches the surface of the drawing paper. Each of these wheels is mounted on a fixed axis running in a line which is parallel to the line through the pen point and the points where the wheels touch the paper. Each is driven by a bidirectional motor. Thus, by rotating each wheel in the same direction at the same rate, the pen point may be made to describe a straight line on the drawing paper; by rotating the wheels at the same rate in opposite directions, to describe a point; and by rotating the wheels at different rates in the same or different directions, to selectively draw any shape of line. Obviously, lifting the point increases the complication of the drawing which may be described.

The mechanical turtle works very well in theory and when well tuned. However, it does have certain inherent problems. First, the motors used to direct the movement of the device must be and remain very accurate for a line to be described which is a precise replica of what is desired. For example, in drawing a straight line the two wheels must move at precisely the same speed or the line will vary in one direction or the other, and possibly in both.

Not only must the motors and the wheels they drive be and remain quite precise, but the computer instructions given to those motors to cause them to operate so that a particular line may be described are quite complicated. For example, to make a circle using this device, it is necessary to cause both wheels to operate at different speeds so that the point describes a curved line having a constant radius from a point. If the circle is smaller in radius than the distance from the pen point to one of the wheels, one form of algorithm is required to operate the wheels, while if the radius is larger than that distance, a different algorithm is required. And with each of these algorithms, the two wheels of the device must move a different rates. This causes the memory space required to provide instructions to accomplish the movement of the device to be quite significant with relations to other aspects of the memory.

The device of this invention accomplishes the same drawing in what outwardly appears to be the same manner while using a greatly simplified mechanical apparatus which allows greatly simplified computer instructions requiring significantly less memory. Furthermore, the device of this invention accomplishes the foregoing while being significantly less subject to variations in mechanical properties which can cause the prior art device to malfunction in producing its output drawings.

It is therefor, an object of the present invention to provide an improved drawing device for use with a computer.

It is another object of the present invention to improve the accuracy with which a peripheral device may be used to describe drawings of various sorts.

It is another object of the present invention to reduce the cost of peripheral drawing devices used with computers.

An additional object of the present invention is to reduce the mechanical complexity of drawing devices used with computers.

Another object of the present invention is to reduce the complexity of the programming needed for operating drawing devices used with computers.

SUMMARY OF THE INVENTION

These and other objects are accomplished in the present invention by a device which comprises a platform which has a single driving wheel depending from one point on its lower periphery and a pen mounted opposite thereto. A pair of closely spaced wheels are mounted to freewheel on opposite sides of the pen so that they touch the paper on a line joining the lowered pen point. The driving wheel is rotated in only a single direction in the preferred embodiment but the direction of its axis of rotation may be varied so that it, in effect, acts as a steering wheel for the device. This configuration allows a point to be described by turning the driving wheel so that its path is at ninety degrees to the line between the pen point and the driving wheel and causing the driving wheel to move at any speed. A straight line is described by moving the driving wheel so that its path is coincident with the straight line to the pen point. A circle is described by rotating the driving wheel to some angle between the two described for a point and a straight line and rotating the driving wheel at any speed. By changing the steering angle as the driving wheel rotates, any other line may be described.

Since only a single driving motor need be used, the motor need operate in only one direction, and the speed of its operation has no effect on the particular line described, it will be clear that the mechanical complexity of the device of the present invention is reduced substantially over that of the prior art device. It is also clear that variations in speed have no effect of the line described nor do two different speeds have to be coordinated in order to describe a particular line.

Since only one driving motor is used which need only turn in one direction and only an angle need be selected to draw a particular line, the program for causing this operation may be quite simple and require very little memory. Of course, with this reduction in complexity, there is a substantial reduction in cost of the device over the prior art device.

Other objects, features, and advantages of the invention will become apparent by reference to the specification taken in conjunction with the drawings in which like elements are referred to by like reference characters throughout the several views.

DESCRIPTION OF THE PREFERRED EMBODIMENT

Figure 1:
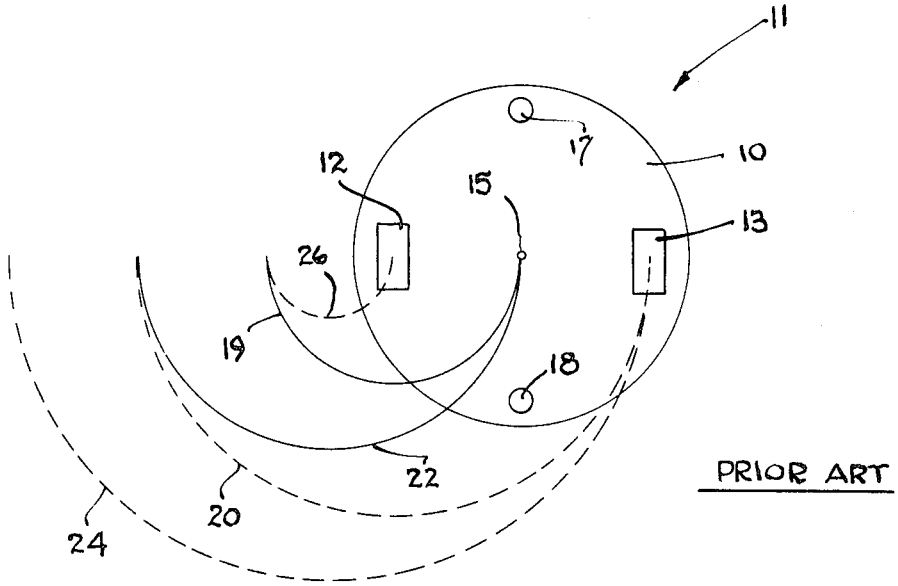
FIG. 1 is a bottom view of the drawing device of the prior art illustrating the position of the mechanism controlling the movement of that device.

FIG. 1 of the drawings shows the underside of a platform 10 of a prior art drawing device 11 used in conjunction with a computer, not shown. The platform 10 has a pair of wheels 12 and 13 each mounted to rotate on the same fixed axis. Halfway between the wheels 12 and 13 is mounted a pen 15 (shown as a point in the Figure). A pair of freewheeling caster wheels 17 and 18 are mounted to the underside of the platform 10 to provide balance.

The device 11 operates to draw a circle as described by the line 19 by moving the wheel 13 along the path 20 while the wheel 12 is held motionless. To draw a larger circle 22, the wheel 13 may be made to describe a path 24; and the wheel 12, a path 26. This requires that the wheels 12 and 13 both rotate in the same direction but that wheel 13 move at a much faster rate than the wheel 12. To draw a circle smaller than circle 19, the wheels 12 and 13 must move in opposite directions at different rates. To draw a straight line, the wheels 12 and 13 must move in the same direction at the same rate. The drawing of a dot requires the wheels 12 and 13 to move in opposite directions at the same rate.

As this description illustrates, the drawing of different lines with the prior art device is quite complex and requires substantially different control signals for each particular line.

Furthermore, if the rate of rotation of either the wheel 12 or the wheel 13 varies from the desired rate, the path of the line drawn by the pen 15 is inaccurate. As the device 11 ages, variation in wheel diameter, freedom of bearings, and the like tend to bring about errors in the precision of the device 11.

Figure 2:
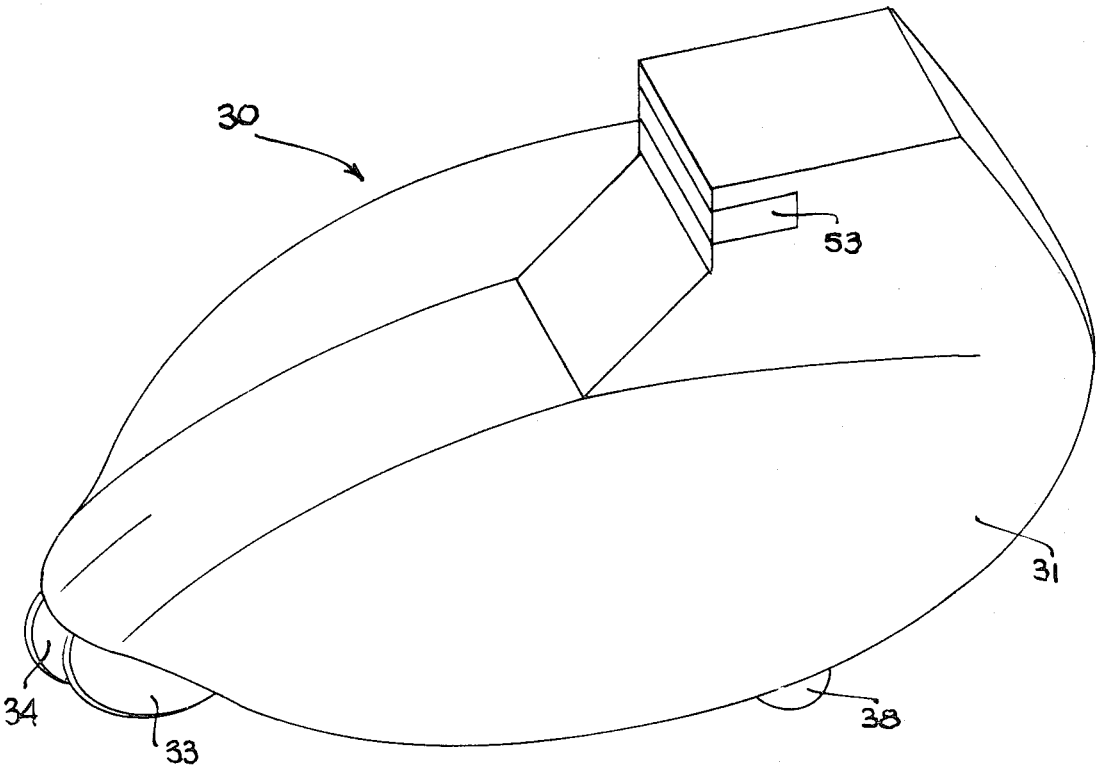
FIG. 2 is a perspective view of the drawing device of the present invention.

FIG. 2 shows a device 30 constructed in accordance with the present invention. The device 30 includes a housing 31 and a platform 32 which cannot be seen in FIG. 2. Projecting down from the platform 32 are a pair of freewheeling wheels 33 and 34 positioned to rotate on the same axis on opposite sides of a pen 36 (shown in FIG. 3).

Figure 3:
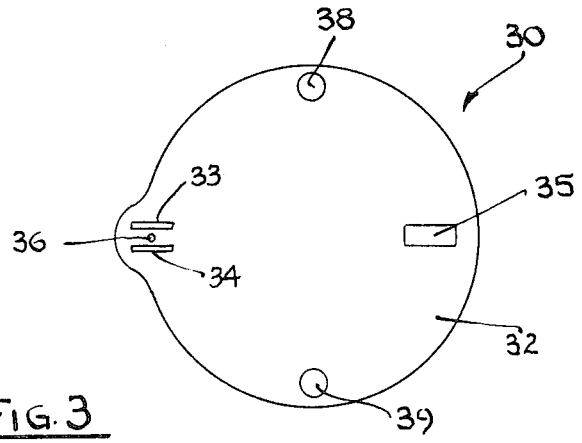
FIG. 3 is a bottom view of the drawing device shown in FIG. 2.

FIG. 3 is a view of the bottom of the device 30 shown in FIG. 2 illustrating only the salient features. The platform 32 mounts the wheels 33 and 34 at its periphery and a single drive wheel 35 at the opposite edge of the periphery. The pen 36 has its point on the line between the points at which the wheels 33 and 34 touch the writing surface. A straight line emanating at the point of the pen 36 and perpendicular to the last-mentioned line will pass through the point of contact of the wheel 35 with the writing surface. A pair of supporting wheels 38 and 39, which may be balls or casters, are also positioned at the periphery of the platform 32 to provide support.

The wheel 35 is mounted so that its direction may be rotated about a vertical axis. In one version of the invention, the path of the wheel 35 rotates about this axis in only one direction so that a simpler mechanization is possible. In the preferred embodiment, however, the path of the wheel 35 rotates in both directions about the vertical. This may be accomplished either by using a bidirectional motor or a reversing gear arrangement to vary the path of the wheel 35.

Figure 4:
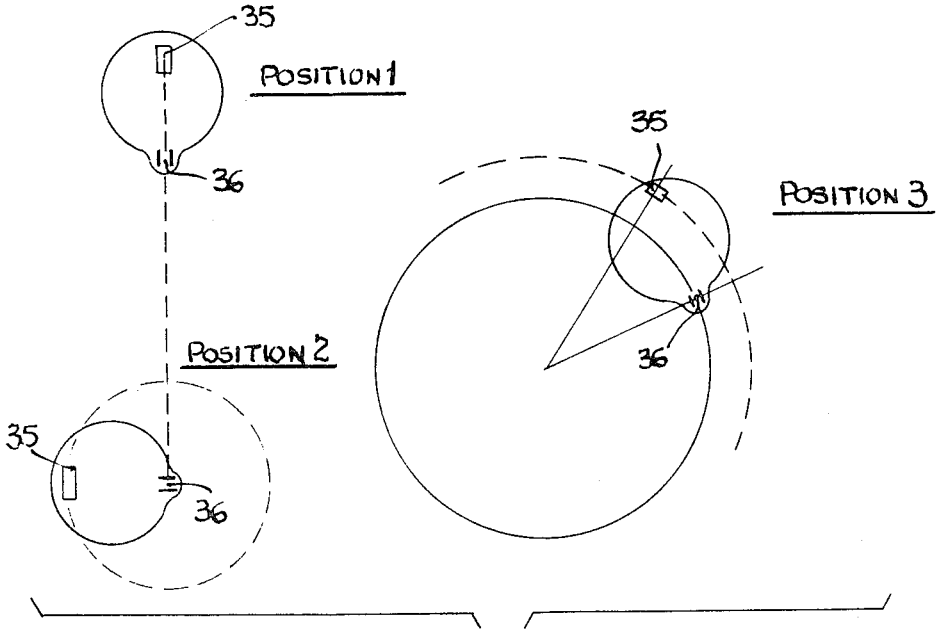
FIG. 4 is a view illustrating various lines which may be described by the device of FIG. 2.

FIG. 4 illustrates the various paths which the device of this invention may be made to describe. To draw a straight line, the pen or other marking instrument 36 is lowered to touch the drawing medium; and the wheel 35 is rotated to follow a path through the dotted straight line through the pen 36 (as shown in Position 1). As the wheel 35 moves, it draws the pen 36 along between the freewheels 33 and 34. To draw a dot, the wheel 35 is directed on a path perpendicular to the straight line between the wheel 35 and the pen 36 (as shown at Position 2). This causes the wheel 35 to rotate about the point 36 as the wheels 33 and 34 freewheel in opposite directions about the pen point 36. To draw any circle, the wheel 35 is directed to an angle other than that for a dot or a straight line and caused to move on its horizontal axis (as shown at Postion 3). The center of the circle described by the pen 36 is found by the intersection of the axis of the wheels 33 and 34 and the axis of the wheel 35. In order to draw any other line, the angle of the wheel 35 about the vertical is varied while the wheel 35 is rotated about its horizontal axis.

It is obvious that the device of the present invention draws any desired line as does the prior art device described above. However, in contrast to the prior art device, the device of the present invention uses a single motor for moving the wheel 35 to draw the pen over the paper, and this motor may rotate at but a single speed in a single direction. The preferred embodiment does also use a bidirectional motor to choose the angle for the path of the wheel 35. Even so, only the direction of the path of the wheel 35 needs to be varied during the drawing of any particular line. In the prior art, both the speed and direction of rotation of two wheels are varied coincidentally to draw most of the lines.

This has two desirable effects. First, the control program necessary to describe a particular line may be made less complicated and thus require less memory in the associated control device. Second, the only control variable being the angle of the wheel 35, there is less which can go wrong to render the line drawn inaccurate. As long as the angle of the wheel 35 is correct or within a reasonable degree of precision, the line drawn will be essentially correct.

This freedom from mechanically induced error is enhanced by the position of the mechanical parts of the device 30. Since the wheel 35 is the only drive wheel, a variation in the freedom of its bearings causes no change in the line drawn. In the prior art device, a change in bearing freedom of one of the two drive wheels varies the accuracy of the line. A variation in the diamemter of the wheel 35 (whether by wear or otherwise) does not vary the accuracy of the line drawn. If one drive wheel of the prior art device varies from that of the other, the line drawn becomes inaccurate. Moreover, the wheels 33 and 34 which freewheel have essentially no effect other than to support the platform. They simply act together much like the single back wheel of a bicycle while the drive wheel 35 acts as the steering front wheel of the bicycle. The wheels 33 and 34 are so close to the pen 36 that even were their bearings to apply different loads, the moment arms are so small that the force applied would have little effect.

Figure 6:
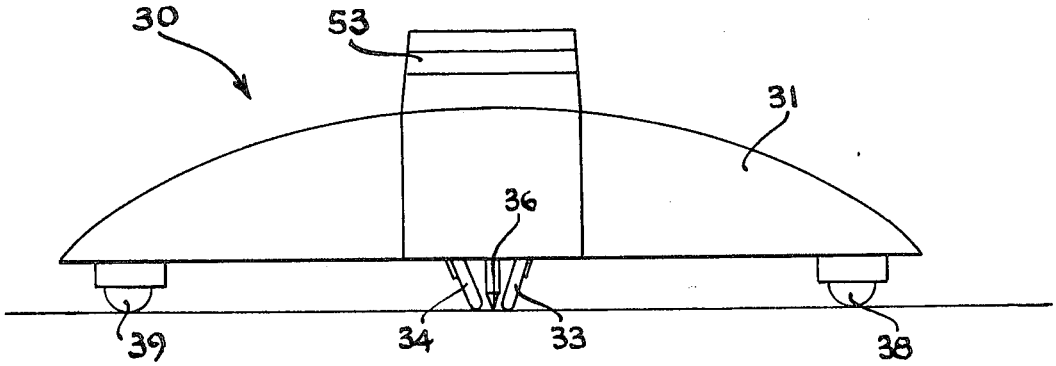
FIG. 6 is a front view of the drawing device shown in FIG. 2.
Figure 7:
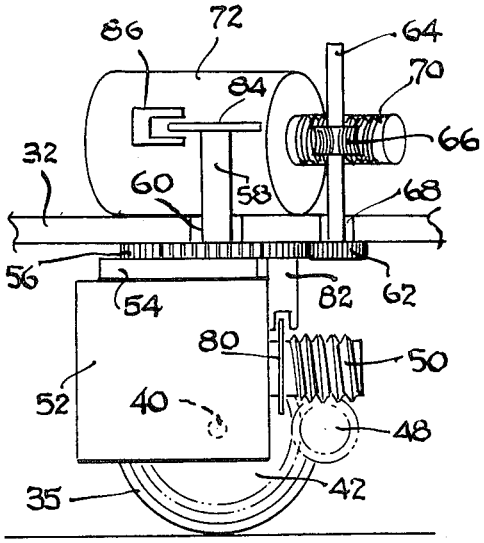
FIG. 7 is a partially cut-away, side view of a fragment of the drawing device of FIG. 2 illustrating a mechanical arrangement for operating the drive thereof.

FIG. 6 illustrates one particular arrangement in which the wheels 33 and 34 are brought even closer together at the point at which they touch the drawing medium in order to further diminish any effect caused by variations in these two wheels. In this arrangement, the wheels 33 and 34 are canted to touch the drawing medium as closely as possible to the tip of the pen 36.

As FIGS. 1, 3, 5, and 6 show, the positions of the supporting wheels 38 and 39 are essentially the same as the positions of the supporting wheels 17 and 18 of the prior art device 11; thus, the effect of those wheels should be essentially the same. Thus, all in all, the device 30 of the present invention is less affected by mechanical aberrations than is the prior art device 11.

Figure 5:
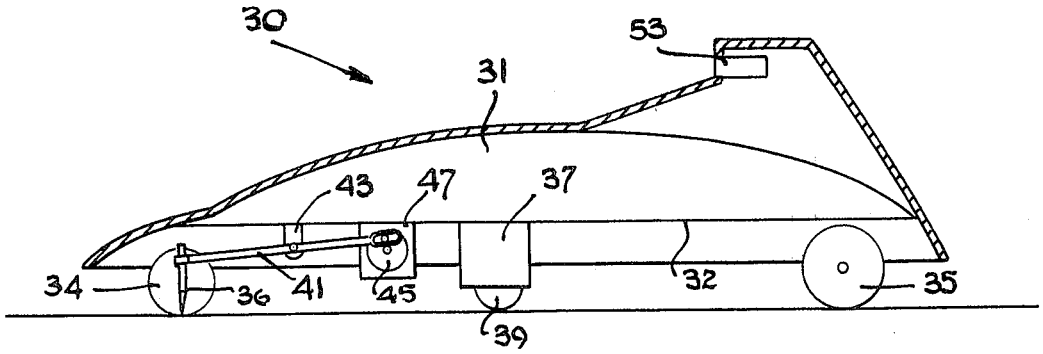
FIG. 5 is a cut-away, side view of the drawing device shown in FIG. 2.

FIG. 5 is a partially cut-away, side view of a device 30 illustrating the positions of the wheels 34, 35 and 39. As may be seen the wheel 39 is held to the platform 32 by a mount 37 which may include means such as a switch for detecting when the wheel 39 leaves the drawing surface and thereby stopping all operations until the device 30 is placed back in the correct position. Also illustrated is an arm 41 which supports the pen 36 and is itself supported by a bracket 43 about which it pivots. The end of arm 41 opposite pen 36 is pivoted to a circular plate 45 which is rotated by a motor 47 secured to the platform 32. The pen 36 is shown in the down position against the drawing paper. If the motor 47 is operated to rotate the plate 45 a half revolution, the pen 36 is raised from the paper. Control signals for operating the motor 47 may be generated in a manner well known to the prior art.

FIGS. 7, 8, 9, and 10 are, respectively, side, end, top and bottom views of the mechanism by which the device of the present invention operates the driving wheel 35 to move about and describe the lines desired under control of a computer. These figures have been cut away as necessary in order to better describe the particular mechanization.

Figure 8:
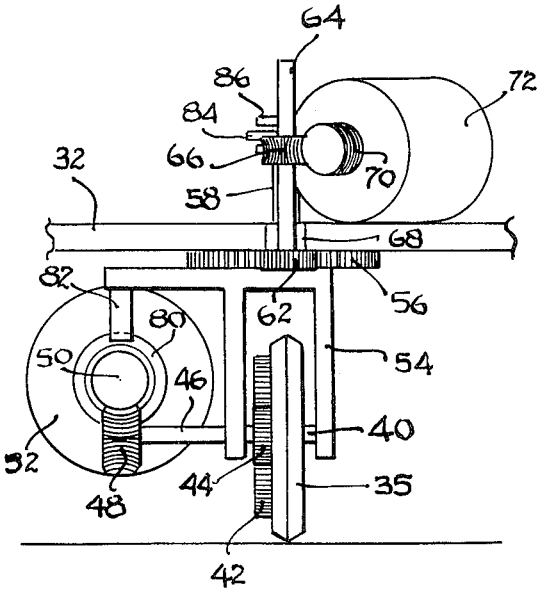
FIG. 8 is a partially cut-away, end view of the fragment of FIG. 7.
Figure 9:
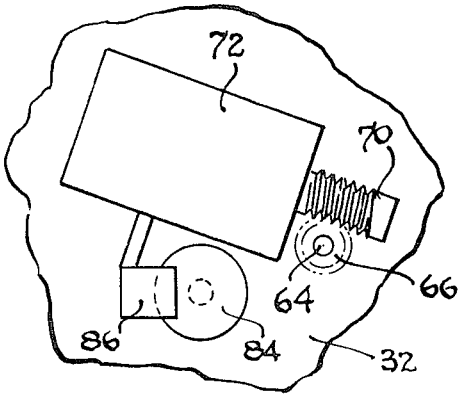
FIG. 9 is a partially cut-away, top view of the fragment of FIG. 7.
Figure 10:
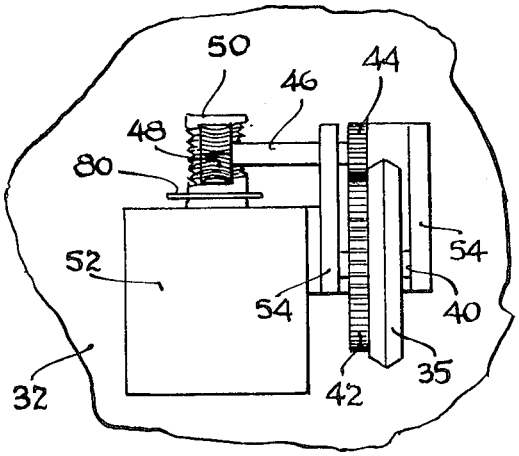
FIG. 10 is a partially cut-away, bottom view of the fragment of FIG. 7.

Shown in these figures is the driving wheel 35 mounted to rotate about a horizontal axis by an axle 40. Fixed to rotate on the same axle 40 with and thereby drive the wheel 35 is a gear 42. In manufacture the wheel 35 and the gear 42 made be molded as a single part if so desired. The gear 42 meshes with and is driven by a gear 44 which rotates on an axle 46 with a spur gear 48. The spur gear 48 is in contact with and is rotated by a worm gear 50 which is driven by the shaft of a motor 52. The motor 52 receives signals causing it to operate from the particular control arrangement with which it is associated. The manner in which this is accomplished is well known to those in the art. In the particular preferred embodiment of the invention, the desired method of controlling the device of the invention is by use of an infra red link to the control circuitry. FIGS. 2, 5, and 6 illustrate a window 53 used for this purpose FIG. 8 illustrates a harness 54 for mounting the motor 52 and the wheel 35 with its associated mechanizing arrangement. As may be visualized, as the motor 52 operates to revolve the worm gear 50, the wheel 35 is rotated in a single direction. The harness 54 is fixed to a gear 56 which rotates about a vertical axis on an axle 58 which protrudes through the a hole in the platform 32 and is supported by a bearing 60. The gear 56 is in contact with and is rotated by a gear 62 which is fixed to a shaft 64 to which is also fixed a spur gear 66. The shaft 64 is supported by a bearing 68 held in an opening in the platform 32. The spur gear 66 is rotated by a worm gear 70 driven by the shaft of a motor 72. The motor 72 is fixed to the upper surface of the platform 32.

The motor 72 is a bidirectional motor in the preferred embodiment and is operated in response to control signals generated in a well known manner. When caused to revolve in one direction, the motor 72 rotates the worm gear 70 in one directon thereby rotating the spur gear 66 and the gear 62 fixed to the same shaft 64. Rotation of the gear 62 rotates the gear 56 and thereby the harness 54 carrying the wheel 35 to a selected path. As may be seen, rotation of the motor 72 in the opposite direction to that just described rotates the wheel 35 in the other direction.

The shaft of the motor 52 supports a disc 80 which passes within a detector 82 so that the position of the shaft may be sensed at any time by the control arrangement, not shown. A similar disc 84 and detector 86 are fixed to monitor the position of the shaft 64 so that the angle of the wheel 35 may be sensed. The discs and detectors may be of any of a number of well known variaties such as optical encoders or the like.

The mechanical parts of the device 30 are all constructed of materials well known to the art.

While a preferred embodiment has been shown and described, it is to be understood that various other adaptations and arrangements might be made which are within the spirit and scope of the invention.

What is claimed is:

1. A drawing device designed to move along a surface, comprising:

a platform;

a marking instrument depending from the platform and having a lower portion positioned to contact the surface at a first point;

a pair of wheels mounted equidistantly on opposite sides of the instrument to contact the surface at second and third points, respectively, where the first, second and third points are colinear and the second and third points are as close as practical to the first point, each of the pair of wheels being mounted to rotate freely;

a drive wheel depending from the platform and seprated from the instrument on a line therefrom perpendicular to the line connecting the first, second and third points;

means for moving the drive wheel to cause the drawing device to move; and means for varying the angle at which the drive wheel moves.

2. A drawing device as claimed in claim 1 in which each of the pair of wheels is canted toward the lower portion of the marking instrument and further including means for raising above and lowering the lower end of the marking instrument to the level of the surface.

3. A drawing instrument as claimed in claim 2 in which the means for raising above and lowering the lower end of the marking instrument includes a motor, a wheel driven by the motor, an arm attached to the instrument and pivotedly attached to the wheel, and means pivoting the arm.

4. A drawing device as claimed in claim 1 in which the means for moving the drive wheel comprises a unidirectional motor arranged to rotate the drive wheel on its axis and the means for varying the angle at which the drive wheel moves comprises a bidirectional motor connected to vary the angle of the path of the drive wheel.

5. A drawing device designed to move along a surface, comprising:

a platform;

a marking instrument depending from the platform and having a lower portion positioned to contact the surface at a first point;

a pair of wheels mounted equidistantly on opposite sides of the instrument to contact the surface at second and third points, respectively, where the first, second and third points are colinear, each of the pair of wheels being mounted to rotate freely and being canted toward the lower portion of the marking instrument;

a drive wheel depending from the platform and separated from the instrument on a line therefrom perpendicular to the line connecting the first, second and third points;

means for moving the drive wheel to cause the drawing device to move; and means for varying the angle at which the drive wheel moves.

6. A drawing device as claimed in claim 2 further including means for raising above and lowering the lower end of the marking instrument to the level of the surface.

7. A drawing device as claimed in claim 5 in which the means for moving the drive wheel comprises a unidirectional motor arranged to rotate the drive wheel on its axis.

8. A drawing device as claimed in claim 5 in which the means for varying the angle at which the drive wheel moves comprises a bidirectional motor connected to vary the angle of the path of the drive wheel.

* * * * *